US007363710B2

(12) United States Patent
Kortleven et al.

(10) Patent No.: US 7,363,710 B2
(45) Date of Patent: Apr. 29, 2008

(54) ROTARY CUTTING TOOL ASSEMBLY

(75) Inventors: Hanno Kortleven, Nieuwerkerken (BE); Jakob Heiberg, Charlottenlund (DK)

(73) Assignee: Dart Industries Inc., Orlando, FL (US)

( * ) Notice: Subject to any disclaimer, the term of this patent is extended or adjusted under 35 U.S.C. 154(b) by 0 days.

(21) Appl. No.: 11/485,405

(22) Filed: Jul. 12, 2006

(65) Prior Publication Data

US 2008/0010838 A1 Jan. 17, 2008

(51) Int. Cl.
*B26B 11/00* (2006.01)

(52) U.S. Cl. ..... 30/143; 30/319

(58) Field of Classification Search ..... 30/123, 30/142, 143, 151, 152, 306, 307, 319, 359; D7/694

See application file for complete search history.

(56) References Cited

U.S. PATENT DOCUMENTS

| | | | | |
|---|---|---|---|---|
| 1,814,547 | A * | 7/1931 | Edwards | 30/143 |
| 2,109,016 | A * | 2/1938 | Ringer | 30/143 |
| 3,286,349 | A | 11/1966 | Larson | |
| 3,995,902 | A * | 12/1976 | Sciaino, Jr. | 294/5 |
| 4,794,692 | A * | 1/1989 | Wang | 30/123 |
| 4,893,408 | A * | 1/1990 | Mattingly et al. | 30/123.5 |
| 5,101,564 | A | 4/1992 | Melter | |
| 5,711,077 | A | 1/1998 | Schulz et al. | |
| D393,987 | S | 5/1998 | Molo | D7/694 |
| 5,765,289 | A | 6/1998 | Schulz et al. | |
| 6,327,783 | B1 | 12/2001 | Ming | |
| D474,081 | S | 5/2003 | Rather et al. | D7/694 |
| 6,584,694 | B2 | 7/2003 | Chen | |
| 6,675,689 | B2 * | 1/2004 | Nunez et al. | 83/745 |
| 7,188,424 | B2 * | 3/2007 | Webster et al. | 30/365 |
| 2004/0231475 | A1 * | 11/2004 | Cornfield et al. | 83/13 |
| 2005/0028388 | A1 * | 2/2005 | Liu | 30/319 |
| 2005/0188545 | A1 | 9/2005 | Poteet | |
| 2006/0037176 | A1 | 2/2006 | McGuyer et al. | |

* cited by examiner

*Primary Examiner*—Hwei-Siu C. Payer

(57) ABSTRACT

A tool assembly comprising a primary tool including a housing internally mounting a rotary cutter blade with a portion of the blade exposed for a cutting action, and a cover for selectively protectively enclosing the cutter blade of the primary tool, the cover also including a housing mounting a second rotary blade partially exposed for cutting action upon utilizing the cover housing as a handle, the primary tool housing protectively enclosing the cover blade simultaneously with the cover protectively enclosing the primary tool blade upon engagement of the cover with the primary tool.

17 Claims, 4 Drawing Sheets

FIG. 3
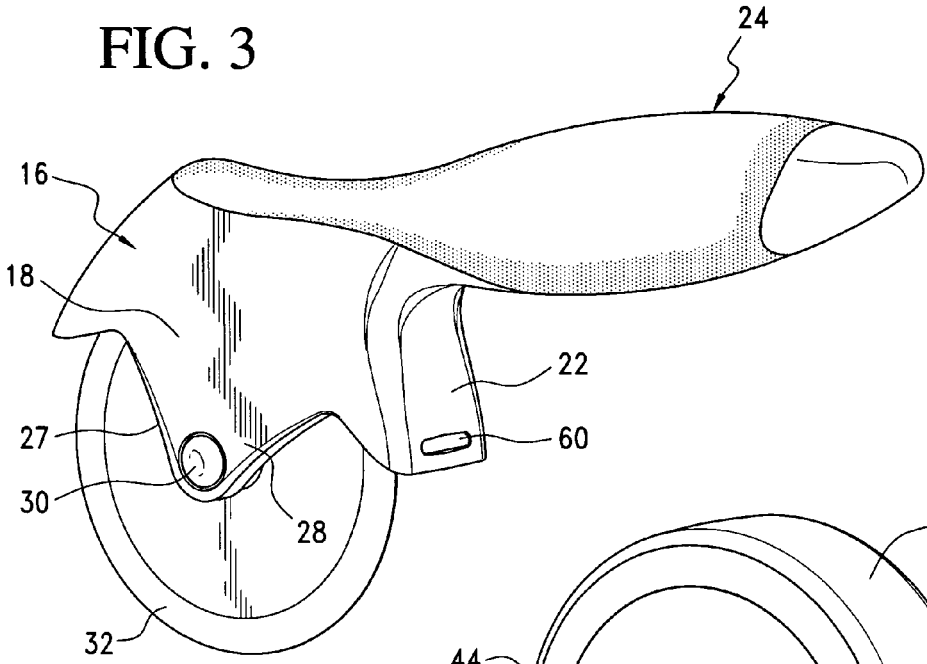
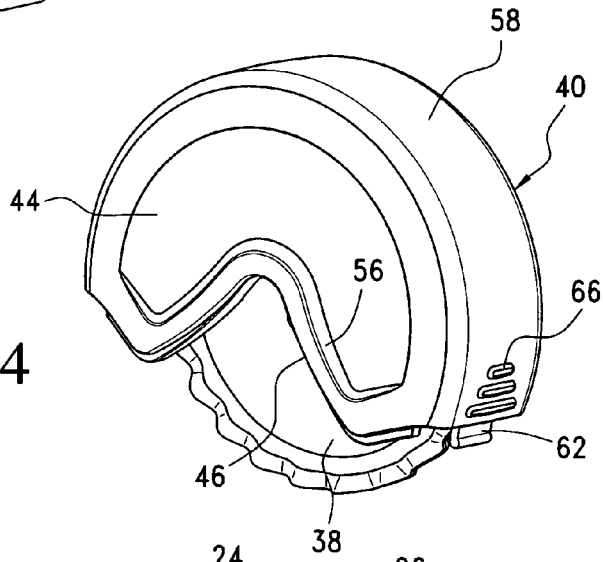
FIG. 4
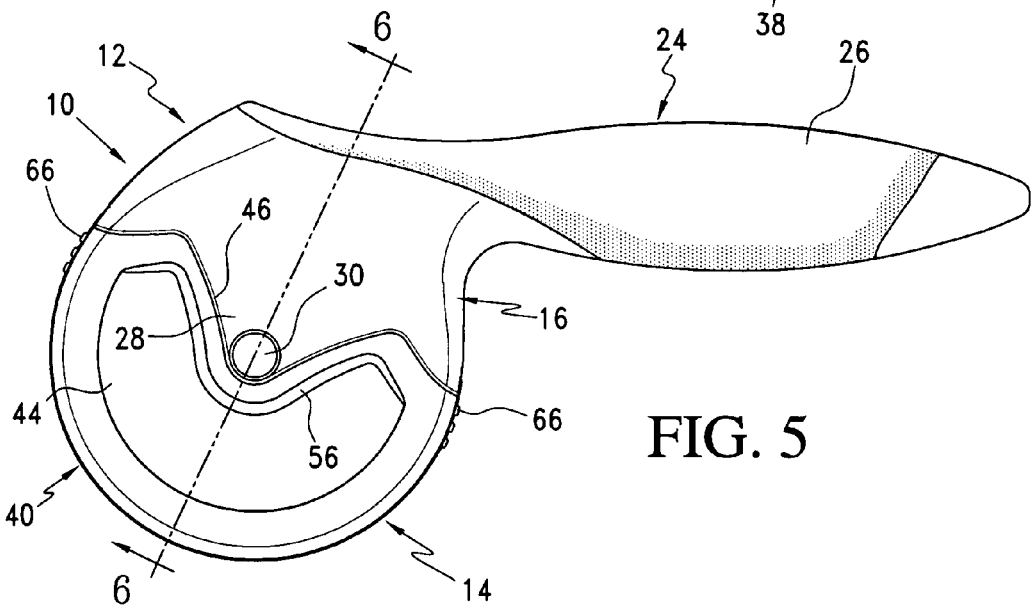
FIG. 5

ROTARY CUTTING TOOL ASSEMBLY

BACKGROUND OF THE INVENTION

The present invention relates to cutting tools incorporating rotary cutting wheels of the type normally considered for use as a kitchen implement or more particularly a cutter for pizza, dough, and like items. Such implements or tools are generally well known and are usually in the form of hand held implements mounting a rotating cutting wheel which rolls along and slices the particular foodstuff or product involved.

Tools of this type, and the broadly related similar hand-held implements for the cutting of a wide variety of sheet materials, in addition to incorporating the rotatable cutting wheel itself, will be provided with a convenient handle and, in some instances, with some form of blade shield or guard. Such cutting tools have also, on occasion, been known to incorporate or utilize interchangeable blades to accommodate varying conditions. This has heretofore necessitated an actual adjustment of the tool to remove or displace one operating blade for subsequent replacement by the desired blade. This in turn normally requires an awkward disassembly and reassembly of the operating components of the tool or a rather complex structural arrangement allowing for blade shifting.

SUMMARY OF THE INVENTION

More specifically, the invention herein presented involves a rotary cutting tool assembly which, in the broader sense, incorporates two distinct cutting blades rotatably mounted within separate housings. Each blade extends beyond its associated housing to provide for a cutting action. The housings are adapted to releasably latch to each other with each housing enclosing the projecting portion of the cutting wheel of the other housing, and thus acting as a protective cover or shield whereby both blades are enclosed. Upon release of the latch means joining the housings, the two blades are exposed, one extending from each of the two housings. Thus, two tools are provided.

As will be seen in the preferred embodiment to be subsequently described, one of the tools may be considered the principal or primary cutter with the housing having an elongate ergonomic handle for manipulation of this tool in a manner similar to that associated with the known tools. As an example, such a tool may be particularly appropriate for use as a pizza cutter. The companion or secondary tool is in the nature of a cover. However, in addition to protectively enclosing and shielding the blade of the primary tool, the secondary tool also independently mounts a second rotating cutting wheel or blade which, as the cover encloses the primary tool blade, is itself received within the housing of the primary tool in spaced parallel relation to the blade therein with both blades thus being effectively concealed and protected and with the entire assembly forming a single unit for conveniently carrying by the elongate handle. The actual use of the secondary tool is easily affected through utilization of the housing or cover thereof as a handle. This tool, as an example, may be more appropriate for use in the cutting of pizza dough prior to the actual formation of the pizza itself. As desired, appropriate gripping means can be provided on the secondary tool cover for ease of manipulation as a handle.

Further features, objects and advantages of the invention will be noted in and become apparent as the construction and details of the invention are more fully hereinafter set forth.

BRIEF DESCRIPTION OF THE DRAWINGS

FIG. 3 is a perspective view of the primary tool from the handle side thereof;

FIG. 4 is a perspective view of the secondary tool illustrating the side of the housing thereof conformed to intimately engage the side wall illustrated in FIG. 3;

FIG. 5 is a side elevational view of the closed tool assembly;

DESCRIPTION OF PREFERRED EMBODIMENTS

Figure 1:
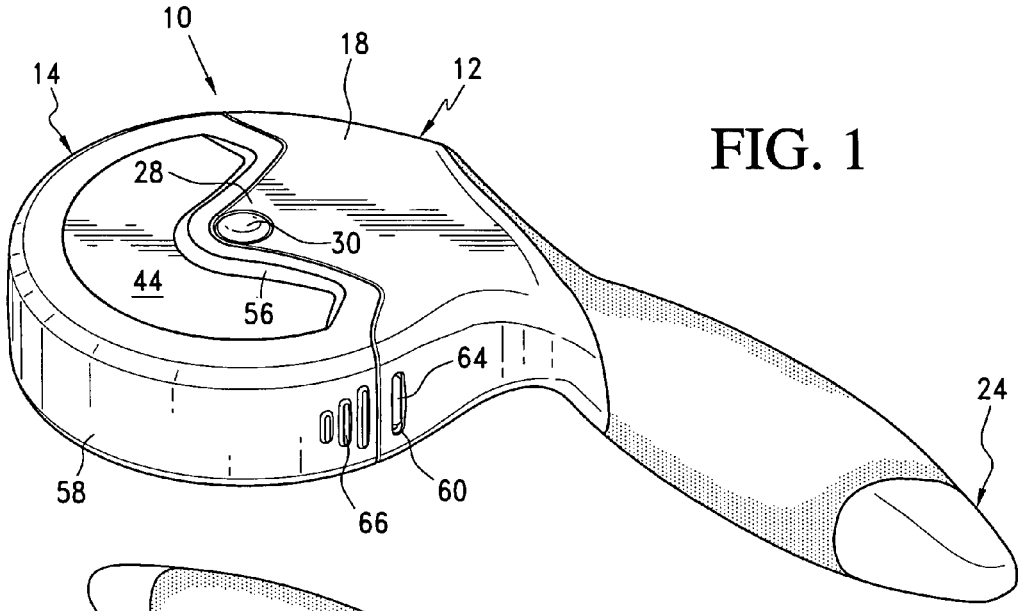
FIG. 1 is a perspective view of the tool assembly of the invention with the cutting blades enclosed.

Referring now more specifically to the drawings, the tool assembly 10 consists basically of two major components, a primary tool 12 and a secondary tool or blade cover 14.

The primary tool 12 includes a downwardly opening housing 16 with laterally opposed first and second side walls 18 and 20 and a transverse top wall portion 22 joining the side walls 18 and 20 above the respective lower edges thereof. In order to handle and manipulate the rotary cutting tool 12, an elongate ergonomically configured handle 24 is integrally formed with the housing 16, and in particular, the transverse top wall 22 thereof, and extends laterally therefrom generally parallel to the side walls 18 and 20 for an easy grasping thereof. As desired, the handle 24 can be provided with an appropriate grip enhancing elastomeric insert 26 which extends about and along a major portion of the handle 24.

Figure 2:
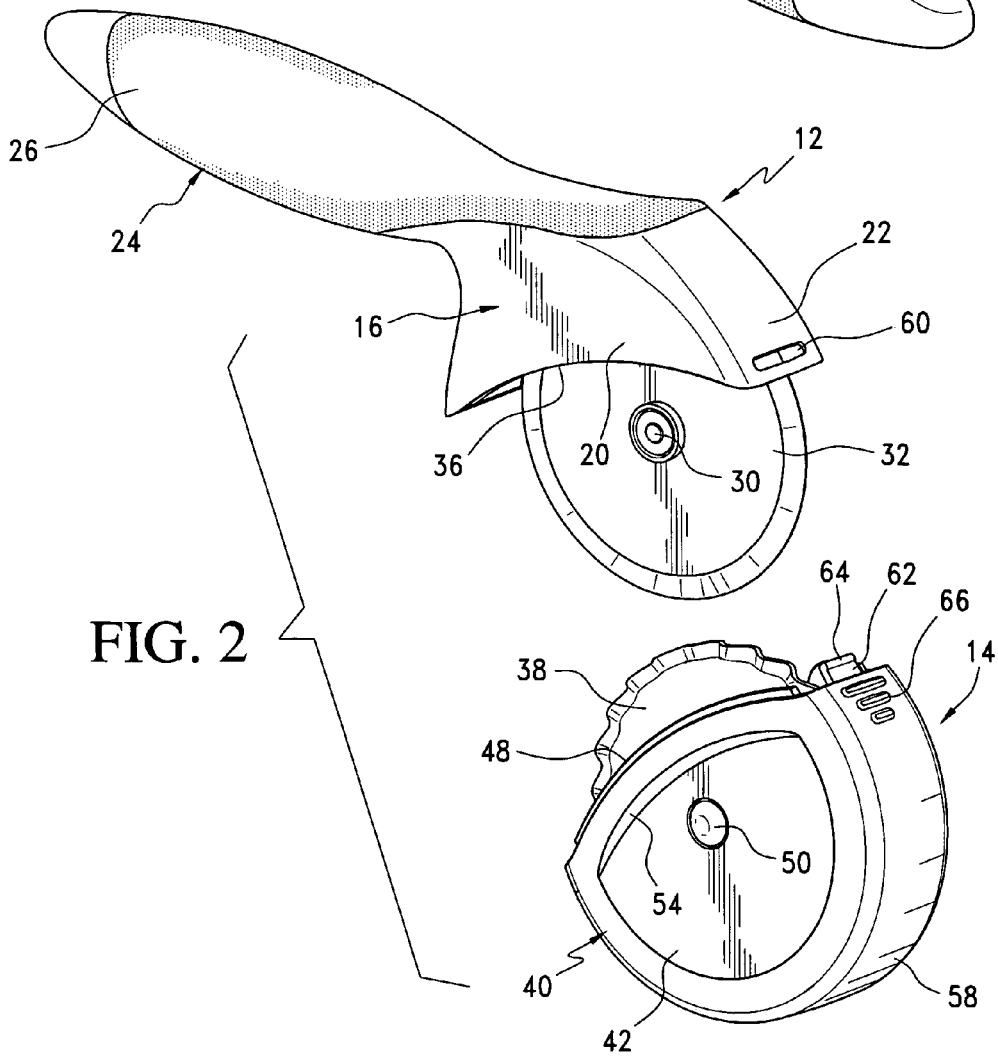
FIG. 2 is a perspective view with the two tools of the assembly disengaged and the blades exposed.
Figure 6:
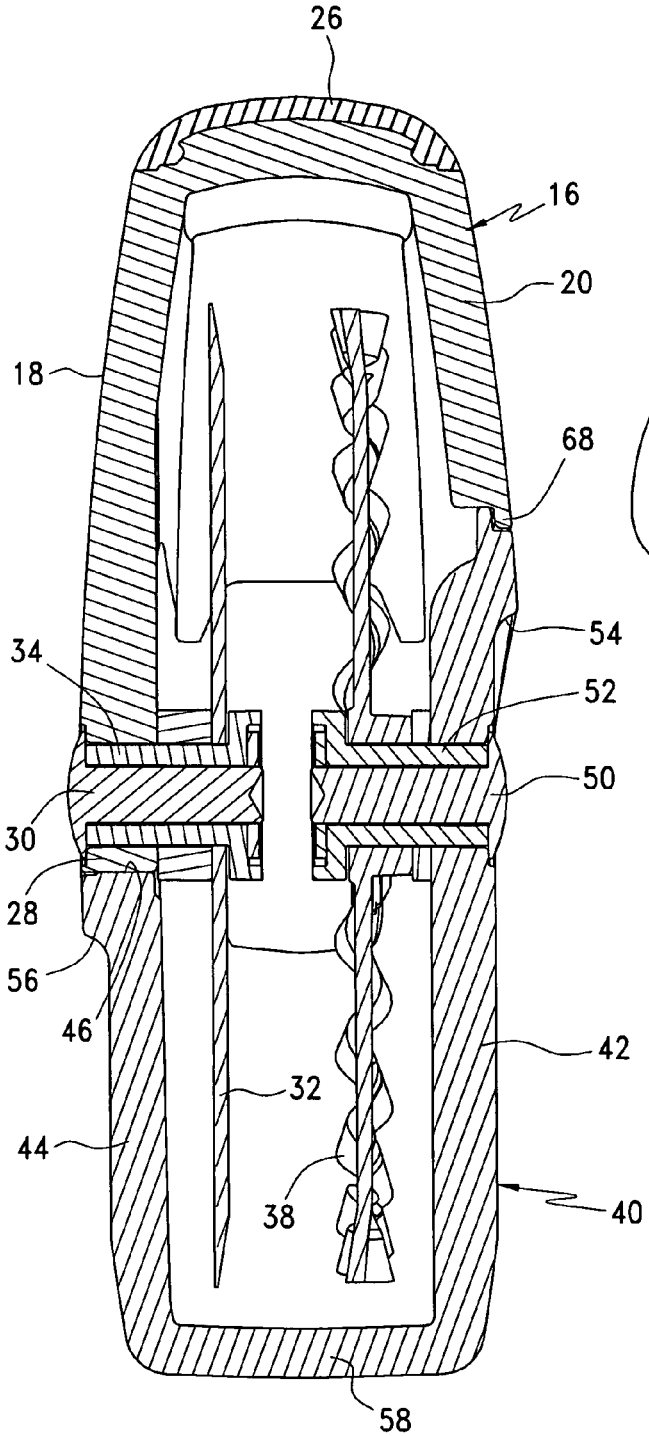
FIG. 6 is an enlarged cross-sectional detail taken substantially on a plane passing along line 6-6 in FIG. 5 and illustrating the parallel relationship of the shielded blades.

Noting FIG. 3 in particular, it will be seen that the side wall 18, along the lower or open edge 27, includes a depending central portion 28 which mounts a stub shaft 30. Referring to FIG. 6 in particular, it will be seen that the stub shaft 30 extends transversely from the side wall 18 and terminates at a point preferably slightly less than one-half the distance between the walls 18 and 20. A circular cutting blade 32, generally paralleling the housing side wall 18 in inwardly spaced relation thereof, rotatably mounts on the stub shaft 30, preferably utilizing an appropriate bushing 34 for free rolling movement about the shaft 30 as a foodstuff is engaged and the wheel blade moved thereacross. The opposed housing wall 20, noting FIG. 2, is of a lesser height than the wall 18 with the lower or open edge 36 thereof positioned above the depending section 28 of the wall 18 and the stub shaft 30 mounted thereto. As will be recognized from the drawings, a substantial portion of the blade 32 is exposed through the opening or open mouth of the housing 16 defined by the lower edges thereof to provide for the desired cutting action.

The secondary tool 14 functions as a cover for the exposed portion of the blade 32 of the tool 12 and uniquely mounts a second rotating cutter blade wheel 38, preferably with a different cutting edge, such as the fluted edge illustrated, as opposed to the straight edge of the first blade 32. The tool 14 includes a housing 40 having laterally spaced generally parallel side walls 42 and 44. Noting FIG. 4, the outer free edge 46 of the side wall 44 includes a central recessed area conforming to the projecting section 28 of the side wall 18 of the first tool 12 with the remainder of this outer edge 46 also conforming to the lower edge of the side wall 18 so as to closely and intimately engage thereagainst as shall be explained subsequently. As will be appreciated, this outer edge 46 of the side wall 44 can also be designated as a lower edge when the tool is held in operative position with the blade 38 downwardly directed.

The side wall 42, noting FIG. 2, is relatively deeper with the outer or lower edge 48 thereof, upon engagement of the tool 14 with the tool 12, conforming closely to and substantially sealing with the edge 36 of the tool 12 and thus extending, when closed, generally beyond the stub shaft 30 mounting the first blade 32.

The blade 38 of the tool cover 14 in turn mounts on a stub shaft 50 affixed to the housing wall 42 and extends transversely inward thereof for a distance normally no greater than one-half the transverse distance between the walls 42 and 44. Appropriate bushing and blade retaining means 52 may be provided to mount the blade 38 for free rotational movement as a work is engaged and the tool 14 moved thereacross. As will be appreciated, the blade 38 projects through the opening or open mouth of the housing 40, defined by the outer edges 46 and 48 thereof, a sufficient distance as to provide for the desired cutting action with the housing 40 itself acting as a convenient easily gripped handle.

Noting FIGS. 2 and 4, in order to enhance and facilitate the use of the housing as a handle, it will be seen that the opposed side walls 42 and 44, immediately inward of the free outer edges 46 and 48 thereof, are slightly recessed so as to define shoulders or abutments 54 and 56 on the respective side walls 42 and 44 against which the user's fingers can engage as pressure is applied during the cutting procedure. Such shoulders 54 and 56 will also provide a guard to reduce any tendency for the hand to slip as downward pressure is applied to the tool.

Noting FIG. 6 in particular, it will be appreciated that in the closed tool assembly, the stub shafts 30 and 50 are axially aligned with the mounted blades 32 and 38 in laterally spaced parallel relation to each other. The stub axles 30 and 50, while preferably of equal length with each extending no further than one-half the transverse distance between the side walls, can vary in length as long as the combined lengths of the shafts allow for an accommodation of both blades in laterally spaced parallel relation to each other and to the side walls. It will also of course be recognized that the lateral spacing between the side walls of the first tool 12 and the second tool 14 are such as to allow for an alignment of the walls of both tools, noting FIGS. 1 and 6 in particular, to provide for a compact streamline assembly with both blades fully enclosed and protected.

Figure 9:
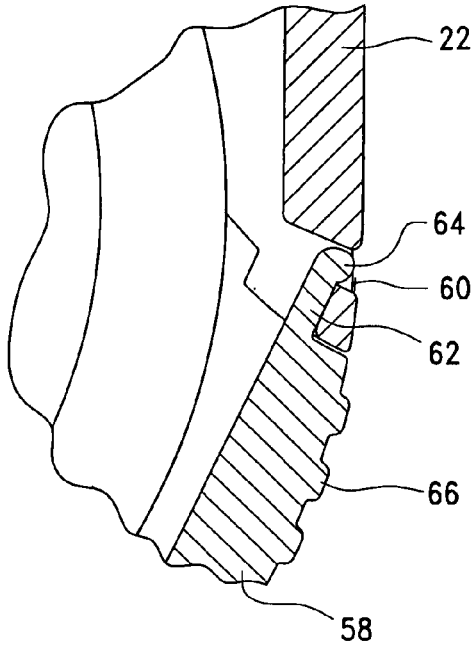
FIG. 9 is an enlarged detail of the area indicated in FIG. 8.
Figure 7:
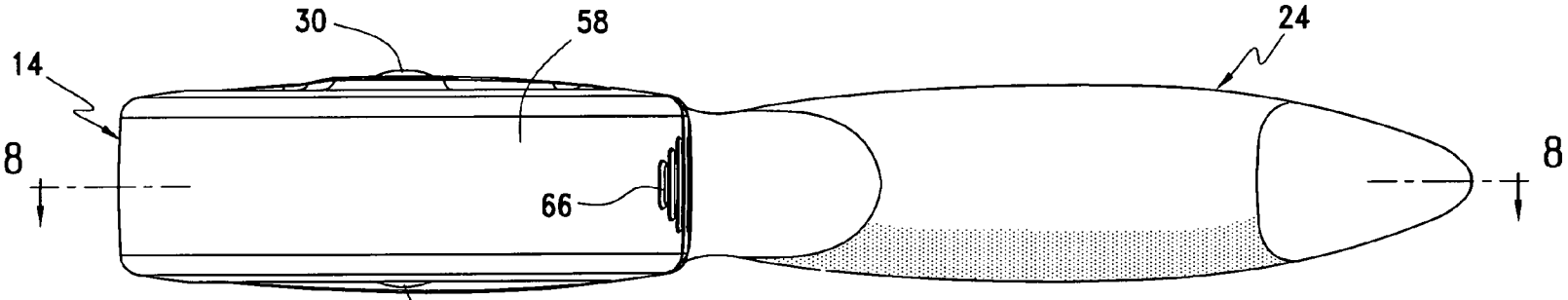
FIG. 7 is a top plan view of the assembly.
Figure 8:
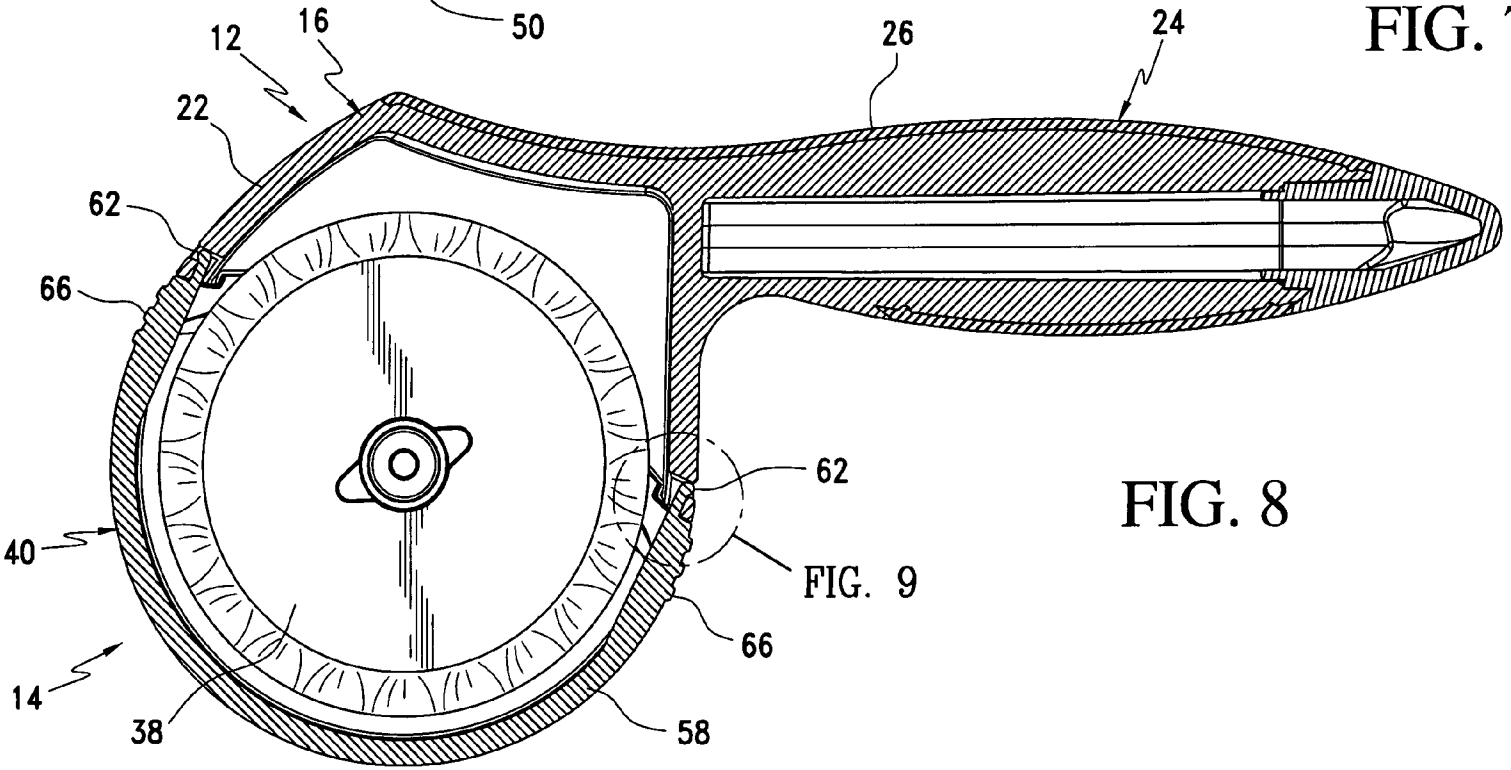
FIG. 8 is an enlarged vertical cross-sectional view taken substantially on a plane passing along line 8-8 in FIG. 7.

The actual interlocking of the two tools, or primary tool and cover, utilizes hand manipulable latch means on both the top wall 22 joining the side walls 18 and 20 of the tool housing 16, and a similar arcuate top wall 58 integral with and joining the laterally spaced side walls 42 and 44 of the cover housing 40 above the mouth-defining free edges 46 and 48 thereof. The extreme end portions of the top wall 22 of housing 16 each include, as a part of the latch mechanism, a transverse keeper slot 60 therein. The opposed free ends of the top wall 58 of the housing 40 each include a projecting lug 62 with an outer edge latching bead 64 which is adapted to outwardly and releasably engage within a corresponding keeper slot 60. Note in particular FIG. 9 wherein the lug 62 is defined along the inner surface portion of the top wall 58 so as to engage inward of the relatively narrower end portion of the top wall 22 of the housing 16 for outward locking engagement of the bead 64 within the keeper slot 60. It is contemplated that, through the inherent resilient flexibility of the cover housing 40, the engagement of the lug beads 64 can be effected automatically upon a manual alignment of the tool housing 40 with the tool housing 16 and an inward movement of the housings toward each other with the bead snap-locking into position. Release of the lugs 62 can be easily affected by a manual inward squeezing of the end portions of the top wall 58 of the housing cover 40. This is facilitated by the provision of appropriate gripping ridges 66 in the top wall 58 immediately adjacent the lug-carrying end portions thereof.

Referring again to FIG. 6, as indicated at 68, the extreme free edges of both housings can, for either the full length thereof or along selected portions, be provided with cooperating shallow stepped extensions and recesses to facilitate alignment and for a more complete sealing of the housings to each other and a complete enclosure of both blades.

As will be appreciated from the above detailed presentation, the invention, in its most basic form, comprises a cutter assembly composed of a cutting blade, for example for slicing pizza, rotatably mounted within a housing having an ergonomic handle extending therefrom. A selectively mountable cover in the nature of an open-ended housing engages over and encloses the blade during periods of non-use. This cover comprises a hand-manipulable housing which also in itself mounts a separate cutting blade for cutting, as an example, pizza dough upon removal of the cover from its protective enclosing of the first mentioned blade. Further, upon a mounting of the cover, in addition to the cover housing enclosing the first mentioned blade, the housing mounting the first blade simultaneously envelopes and encloses the exposed portion of the cover blade. In this manner, both blades, while protectively enclosed, are readily available for independent use upon disengagement of the cover from the first housing.

The detailed explanation of the invention as set forth above, is considered illustrative of the principles of the invention. It is appreciated that modifications and changes, may occur to those skilled in the art. As such, it is not desired to limit the invention to the exact construction and manner of use as shown and described. Rather, all suitable modifications and equivalents may be resorted to as falling within the scope of the invention as claimed.

The invention claimed is:

1. A cutting tool comprising a first cutter blade, a housing mounting and partially enclosing said blade, a portion of said blade extending outward of said housing for cutting action, a cover, means for removably mounting said cover to said housing and enclosing said extending blade portion, a second cutter blade mounted within said cover with a portion of said second cutter blade extending outward of said cover for cutting action, said second blade, upon mounting of said cover to said housing, generally paralleling said first blade in lateral alignment therewith and with the extending portion of the second blade being received in and concealed by said housing, and wherein said housing comprises a pair of laterally spaced first and second side walls, said side walls having outer edges defining an opening from said housing through which said first blade extends, said cover comprising a pair of laterally spaced first and second side walls having outer edges defining an opening through which said second blade extends, a stub shaft fixed to said first side wall of said housing and extending laterally therefrom toward said second side wall of said housing and rotatably mounting said first cutter blade, a second stub shaft fixed to said first side wall of said cover and extending laterally therefrom toward said second side wall of said cover and rotatably mounting said second cutter blade, said stub shafts axially align, upon a mounting of said cover to said housing.

2. The cutting tool of claim 1 wherein the outer edge of said first side wall of said housing and the outer edge of the second side wall of said cover have conforming configurations and intimately engage upon mounting of said cover to said housing and wherein the outer edge of said first side wall of said cover and the outer edge of said second side wall of said housing have conforming configurations and intimately engage upon mounting of said cover to said housing whereby said blades are completely enclosed.

3. The cutting tool of claim 2 wherein each of said stub shafts extend a distance no greater than one-half the distance between the corresponding first and second side walls, and wherein said stub shafts axially align upon a mounting of said cover to said housing.

4. The cutting tool of claim 3, wherein said means for removably mounting includes hand manipulable and releasable latch means mounted to said cover and said housing for releasable securing of said cover to said housing.

5. The cutting tool of claim 4 wherein said cover defines a hand accommodating handle for manipulation of said second cutter blade.

6. The cutting tool of claim 5 wherein outer surfaces of said first and second side walls of said cover include finger engaging abutments defined thereon for an enhanced gripping and manipulation of said cover.

7. A tool assembly comprising a tool having a first cutter blade, a tool housing mounting and partially enclosing said blade, a portion of said blade extending beyond said tool housing to provide for a cutting action upon manipulation of said tool, a cover housing selectively mountable to said tool housing and enclosing said extending portion of said blade, said cover housing mounting a second cutter blade with a portion thereof extending beyond said cover housing to provide for a cutting action through manipulation of said cover housing independently of said tool, means for releasably mounting said cover housing to said tool housing for enclosing said first cutter blade, said tool housing receiving and concealing the extending portion of said second cutter blade upon mounting of said cover housing to said tool housing, and wherein said tool housing includes a pair of laterally spaced first and second side walls, said side walls having outer edges defining an opening through which said first cutter blade extends, said cover housing comprising a pair of laterally spaced first and second side walls, said cover housing side walls having outer edges defining an opening through which said second cutter blade extends, the lateral spacing between the first and second side walls of said tool housing and said cover housing being generally equal and sufficient so as to accommodate both blades in generally laterally spaced parallel relation to each other.

8. The tool assembly of claim 7 wherein said cover housing defines a handle for manipulation of said second cutter blade, said first and second side walls of said cover housing including grip-enhancing means thereon for accommodating the hand of a user.

9. The tool assembly of claim 8 including a stub shaft fixed to said first side wall of said tool housing and extending laterally therefrom toward the corresponding second side wall, said stub shaft mounting said first cutter blade, said cover housing first side wall having a second stub shaft fixed thereto and extending laterally therefrom toward said second side wall of said cover housing, said second stub shaft mounting said second cutter blade, said stub shafts, upon a mounting of said cover housing to said tool housing, being in axial alignment with the two cutter blades laterally aligned within the enclosing tool and cover housings.

10. The tool assembly of claim 9 wherein said second side wall of each housing has the outer edge thereof generally recessed relative to the outer edge of the corresponding first side wall, said outer edge of said tool housing first side wall and said outer edge of said cover housing second side wall having conforming configurations, and said outer edge of said cover housing first side wall and said outer edge of said tool housing second side wall having conforming configurations for intimate engagement upon mounting of said cover housing to said tool housing.

11. A tool assembly comprising releasably interlocking first and second tools, each tool including a cutter blade and handle means for holding and manipulating the blade, said handle means of each tool defining a protective housing partially enclosing the corresponding blade, each housing having an opening therein with each blade extending outward through the corresponding housing opening to provide an exposed blade portion for use as a cutter upon manipulation of the handle means, and means for selectively joining said housings to each other in a storage configuration protectively enclosing the exposed blade portions of each blade, and wherein each tool housing and the opening in each housing are of a size sufficient to receive the partially exposed blade portion of the other tool with the housings engaged and the openings therein aligned, said means for selectively joining said housings comprising hand manipulable cooperating latch components on both said housings.

12. The tool assembly of claim 11 wherein each cutter blade comprises a circular blade with a peripheral cutting edge.

13. The tool assembly of claim 12 wherein each housing comprises a pair of laterally spaced first and second side walls, said side walls having outer edge portions defining the housing opening; each housing further including a transverse top wall extending between said side walls remote from said outer edge portions, each housing having a stub shaft fixed to said first side wall and extending laterally toward the second side wall thereof for an extent generally no greater than one half the distance defined between said first and second side walls, each said stub shaft rotatably mounting one of said cutter blades generally parallel to the corresponding first side wall.

14. The tool assembly of claim 13 wherein the outer edge portion of the first side wall of each housing and the outer edge portion of the second side wall of the other housing having conforming configurations and being intimately engaged in said joined housings.

15. The tool assembly of claim 14 wherein said second side wall of each housing has the outer edge portion thereof generally recessed relative to the other outer edge portion of the corresponding first side wall.

16. The tool assembly of claim 11 wherein each housing comprises a pair of laterally spaced first and second side walls, said side walls having outer edge portions defining the housing opening; each housing further including a transverse top wall extending between said side walls remote from said outer edge portions, each housing having a stub shaft fixed to said first side wall and extending laterally toward the second side wall thereof for an extent generally no greater than one half the distance defined between said first and second side walls, each said stub shaft rotatably mounting one of said cutter blades generally parallel to the corresponding first side wall.

17. The tool assembly of claim 16 wherein the outer edge portion of the first side wall of each housing and the outer edge portion of the second side wall of the other housing having conforming configurations and being intimately engaged in said joined housings, said stub shafts, in said joined housings, being in generally axial alignment with said blades adjacent and parallel to each other.

* * * * *